US005155769A

United States Patent [19]

Werrbach

[11] Patent Number: 5,155,769

[45] Date of Patent: Oct. 13, 1992

[54] DISCRETE PARALLEL PATH MODULATION MULTIPLEXER

[75] Inventor: Donn R. Werrbach, Seattle, Wash.

[73] Assignee: Aphex Systems, Ltd., Sun Valley, Calif.

[21] Appl. No.: 685,212

[22] Filed: Apr. 12, 1991

[51] Int. Cl.[5] ..... H04H 5/00

[52] U.S. Cl. ..... 381/7; 381/2; 381/14

[58] Field of Search ..... 381/14, 7, 4

[56] References Cited

U.S. PATENT DOCUMENTS 3,257,511 6/1966 Adler et al. ..... 381/4
4,516,257 5/1985 Torick ..... 381/4
4,704,727 11/1987 Beard ..... 381/13

*Primary Examiner*—Jin F. Ng
*Assistant Examiner*—Edward Lefkowitz
*Attorney, Agent, or Firm*—Edward A. Sokolski

[57] ABSTRACT

A discrete parallel path modulation multiplexer for use in generating a composite baseband signal from separate left and right input signals. The composite baseband signal includes the sum of the left and right input signals and the product of the difference between the left and right input signals and a subcarrier. The composite baseband signal may also include a pilot subcarrier at one-half the frequency of the subcarrier. In one signal path, the multiplexer multiplies the right input signal by the function (1+sin (wt)) and in a second signal path the multiplexer multiplies the left input signal by the function (1−sin (wt)). The products are then combined to obtain the composite baseband signal. A pilot subcarrier may also be generated and included as part of the composite baseband signal.

4 Claims, 4 Drawing Sheets

DISCRETE PARALLEL PATH MODULATION MULTIPLEXER

1. BACKGROUND OF THE INVENTION a. Field of the Invention

This invention pertains to devices for frequency multiplexing multiple signals upon one radio frequency carrier.

More particularly, this invention pertains to devices for generating a composite baseband signal that is used to modulate the radio frequency carrier. For instance, in stereophonic broadcasting systems, the radio frequency carrier typically is frequency modulated by a composite baseband signal, which composite baseband signal includes a main channel signal, a subchannel signal and, in many instances, a pilot subcarrier.

In the typical system the stereo input signal is composed of a "left" audio signal and a "right" audio signal. The composite baseband signal is the sum of the left and the right audio signals and a subchannel signal which consists of the sidebands that would be generated by a suppressed subcarrier, balanced modulator that is modulated by the difference between the left and right audio signals. The composite baseband signal may also include a pilot subcarrier that typically is one-half the frequency of the subcarrier. The pilot carrier is used as a reference for the frequency and phase of the subcarrier for use in connection with the demodulation of the subcarrier sidebands.

The Engineering Handbook, National Association of Broadcasters, Department of Technology, Washington D.C. (referred to herein as the "NAB Handbook") describes in some detail the technical specifications for such stereophonic frequency modulated signals and for the composite baseband signal.

If the left audio signal is represented by L, where L is a time varying function, and the right audio signal is similarly by R, and the subcarrier is represented by sin(wt) the composite baseband signal is represented by the sum of the left and right audio signals and the product of the subcarrier by the difference of the left and right audio signals, that is:

$$\text{composite baseband signal} = L + R + (L - R)*\sin(wt) + \text{pilot subcarrier (if any)} \quad (1)$$

The pilot subcarrier having a frequency of one-half of the frequency of the subcarrier may or may not be present.

The present invention is a device for generating the composite baseband signal. Although a primary application of the present invention is the generation of composite baseband signals for use in stereophonic FM broadcasting systems, the invention is also applicable to other communication systems, including but not limited to television stereophonic transmission systems, that utilize subchannels for the transmission of multiple signals over one communication system. A pilot subcarrier may be included the invention, but it is not a necessary element of the present invention.

b. Description of the Prior Art

Chapter 4 of the NAB Handbook describes in conceptual terms various methods for generating the composite baseband signal. For instance, FIG. 1 hereof (FIG. 3 in Chapter 4 of NAB Handbook) depicts a frequency division multiplex stereo generator in which the left and right audio signals are combined in a matrix to produce the sum and difference of these signals. The difference between the left and right audio signals is applied to a balanced modulator operating at the subcarrier frequency and the output of the modulator is combined with the sum of the left and right audio signals to produce the composite baseband signal.

FIG. 2 hereof (FIG. 5 of chapter 4 of the NAB Handbook), by means of a block diagram, conceptually depicts a time division multiplex stereo generator which makes use of a switching modulator operating at the subcarrier frequency to generate the composite baseband signal.

FIG. 3 hereof (FIG. 6 of chapter 4 of the NAB Handbook), by means of a block diagram, depicts a time division multiplex stereo generator that utilizes a variable attenuator. Although the NAB Handbook describes these multiplex generators in conceptual terms, no mechanisms are described for effecting these various devices.

A company named C. N. Rood in the Netherlands markets a number of different stereo encoders. Its stereo encoder model SC-200 is apparently based on the concept of the variable attenuator depicted in FIG. 3.

2. SUMMARY OF THE INVENTION

The present invention utilizes a method for generating the composite baseband signal that is, to some extent, related to the concept of the variable attenuator depicted in FIG. 3. However, rather than multiplying the combination of the left and right signals in one circuit by a varying attenuator as depicted in FIG. 3, the present invention multiplies the left audio signal by the function (1+sin(wt)) in a separate, discrete modulation device operating at the subcarrier frequency and multiplies the right audio signal by the function (1−sin(wt)) in a second, separate, discrete modulation device also operating at the subcarrier frequency, where the subcarrier is represented by sin(wt). The outputs from the two separate, discrete modulation devices are then added together to obtain the composite baseband signal.

3. BRIEF DESCRIPTION OF THE DRAWINGS

4. DETAILED DESCRIPTION

Figure 1:
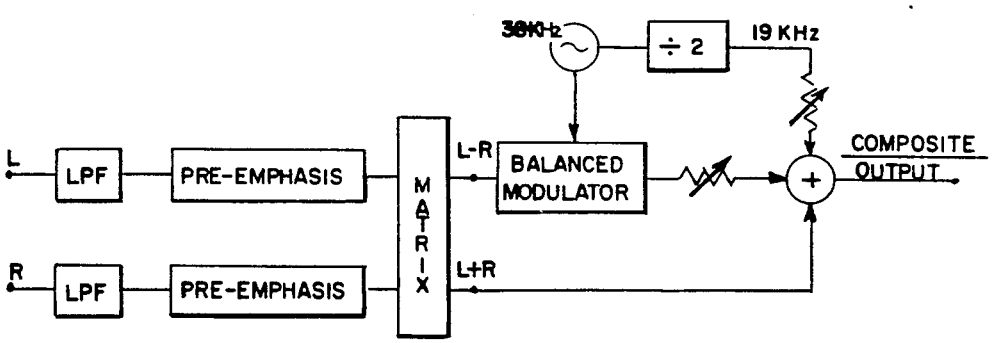
FIG. 1 PRIOR ART
FIG. 1 is conceptual block diagram of a frequency division multiplex stereo generator.
Figure 2:
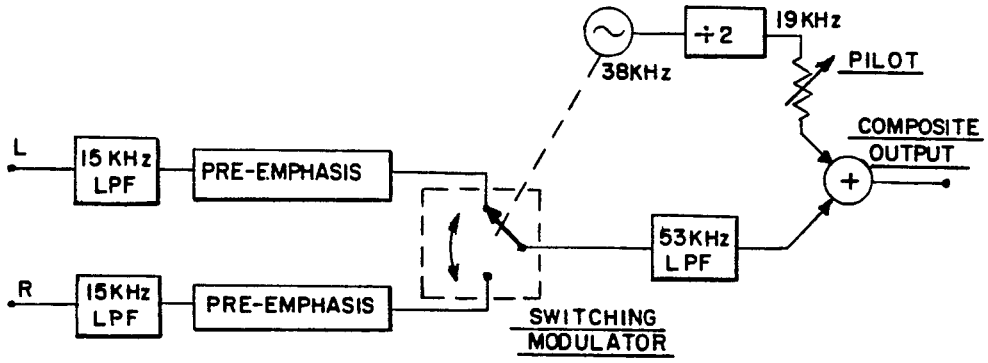
PRIOR ART FIG. 2
FIG. 2 is a conceptual block diagram of a time division multiplex stereo generator.
Figure 3:
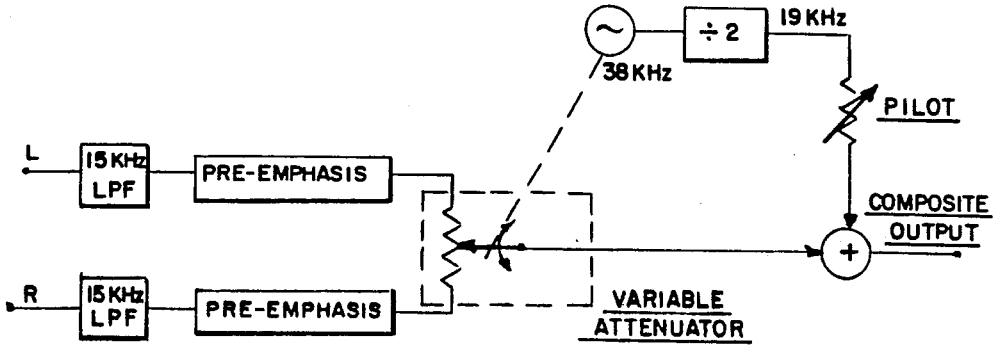
FIG. 3 PRIOR ART
FIG. 3 is a conceptual block diagram of a time division multiplex stereo generator that uses a variable attenuator.
Figure 4:
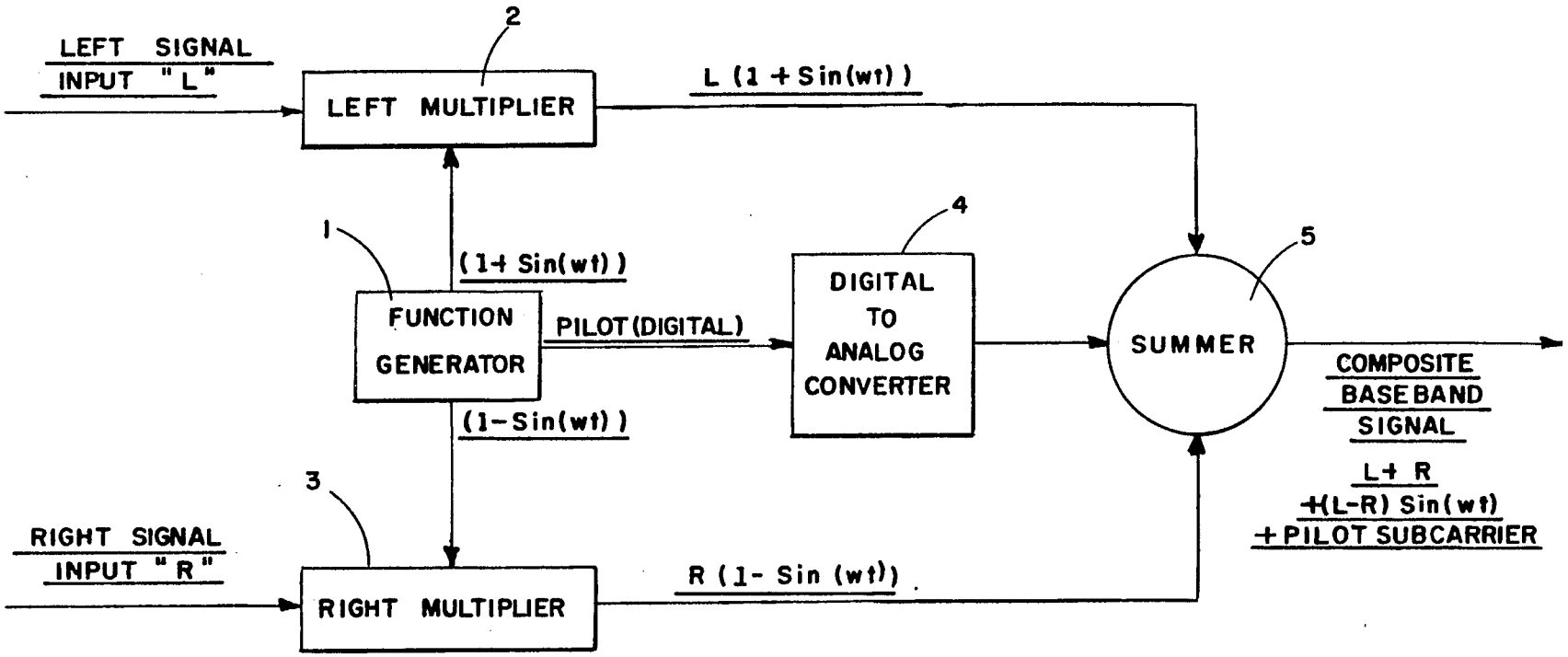
FIG. 4 is a functional block diagram of the present invention, a discrete, parallel path, modulation multiplexer.

Referring now to FIG. 4, function generator 1 generates the function (1+sin(wt)) in digital form and outputs the function to left multiplier 2. Generator 1 also generates the function (1−sin(wt)) in digital form and outputs the function to right multiplier 3. Generator 1 also generates the function sin(wt/2) in digital form and outputs this function to digital-to-analog converter 4. Left multiplier 2 receives the left signal as an analog input, receives the function $(1+\sin(wt))$ in digital form and multiplies the two inputs together to provide an output in analog form that is equal to $L(1+\sin(wt))$, where L represents the time varying left input signal. Right multiplier 3 receives the right signal as an analog input, receives the function $(1-\sin(wt))$ in digital form and multiplies the two inputs together to provide an output in analog form that is equal to $R(1-\sin(wt))$ where R represents the time varying right input signal. Digital to analog converter 4 receives $\sin(wt/2)$ in digital form and outputs the pilot subcarrier which is an analog signal, $\sin(wt/2)$, having an adjustable small magnitude. The outputs from left multiplier 2 and right multiplier 3 and digital-to-analog converter 4 are added together in summer 5 to provide an output of:

$$\text{output} = L + R + (L-R)\sin(wt) + \text{pilot subcarrier}, \quad (2)$$

which output is the composite baseband signal.

It should be understood that the left and right multipliers and the summer may be mechanized in many different ways and by both analog and digital systems. This specification describes a partly digital and partly analog embodiment of this invention. It should be further understood, that the designation of the input signals as left and right is interchangeable. It should be further understood that the designations of left and right are intended only to differentiate between a first and a second input signal and it should be understood that such designation does not limit the application of this invention to audio sterophonic systems. It should be further understood, that the outputs from the multipliers include a multiplicative scaling constant.

Figure 5:
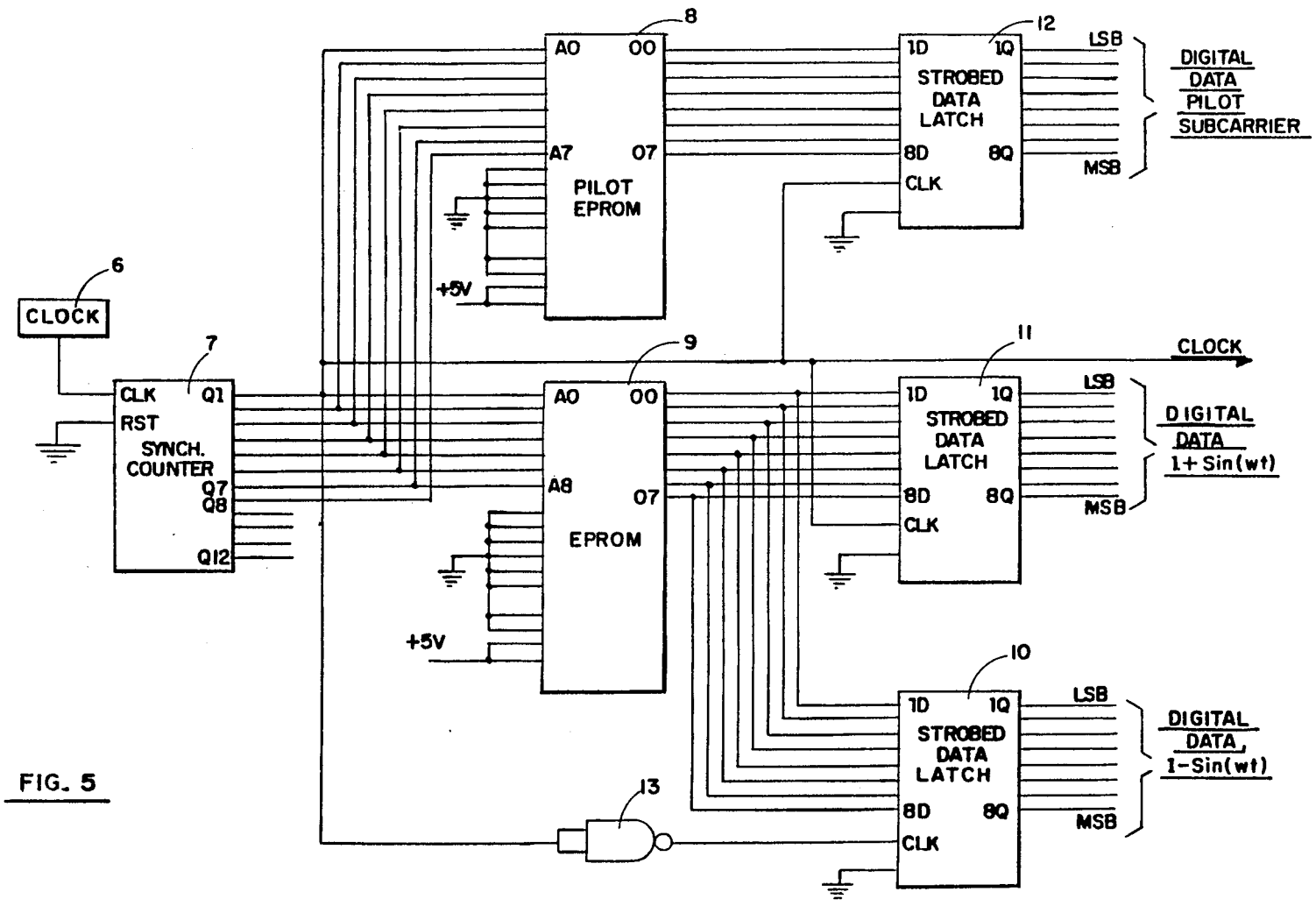
FIG. 5 is a diagram of the function generator of the invention.

Referring now to FIG. 5 which depicts in more detail function generator 1. When used in a system having a subcarrier frequency of 38 kilohertz, clock 6 operates at 4.864 megahertz, which is 128 times the subcarrier frequency. The output from clock 6 drives synchronous counter 7 which is a 12-stage synchronous counter such as a 74HC4040. The lowest 8 output data bits from counter 7, i.e. Q1 through Q8 are connected to input address lines A0 through A7 of pilot EPROM 8. Pilot EPROM 8 is an eraseable programmable memory chip such as the EPROM type M27128A-2F1 made by Silicon Technology. The lowest 7 output data bits from counter 7, i.e. Q1 through Q7 are also connected to input address lines A0 through A6 of subcarrier EPROM 9 which is also an eraseable programmable memory chip such as the 2764.

The data stored in EPROMs 8 and 9 that are addressed by the addresses output by counter 7 are input to strobed data latches 10, 11 and 12. A 74HC374 is a suitable for use as such a strobed data latch. The output Q1 from counter 7 provides the clock or "strobe" to strobed data latches 11 and 12. The output Q1 from counter 7 is input to inverter 13, which inverts the clock or strobe signal and outputs this inverted signal to strobed data latch 10. One of the summers in a 7400 can serve as inverter 13.

A quantized digital representation of the pilot subcarrier $(\sin(wt/2))$ is stored in the sequence of addresses in EPROM 8. The pilot subcarrier is quantized to 8 bit accuracy, i.e. 256 levels and 128 samples are used to construct the pilot subcarrier. Because clock 6 operates at a frequency of 4.864 megahertz, the frequency of the pilot subcarrier is 19 kilohertz.

Quantized digital representations of $(1+\sin(wt))$ and of $(1-\sin(wt))$ are stored at alternate addresses in EPROM 9. The digital representation of each of the two functions is stored to 6 bit accuracy, i.e. to 64 levels, and 64 samples per cycle are stored for each of the two functions. Because strobed data latch 11 is "strobed" by Q1 of counter 7, and strobed data latch 10 is strobed by the inverted signal from Q1, the data stored in "even" addresses goes to one of the strobed data latches while the data stored in the "odd" addresses goes to the other latch. Because of the inversion of the clock signal to one of the latches, the data that is latched in one of the two data latches is offset in time from the data latched in the other latch. The functions $(1+\sin(wt))$ and $(1-\sin(wt))$ are each generated at a frequency of 38 kilohertz.

Figure 6:
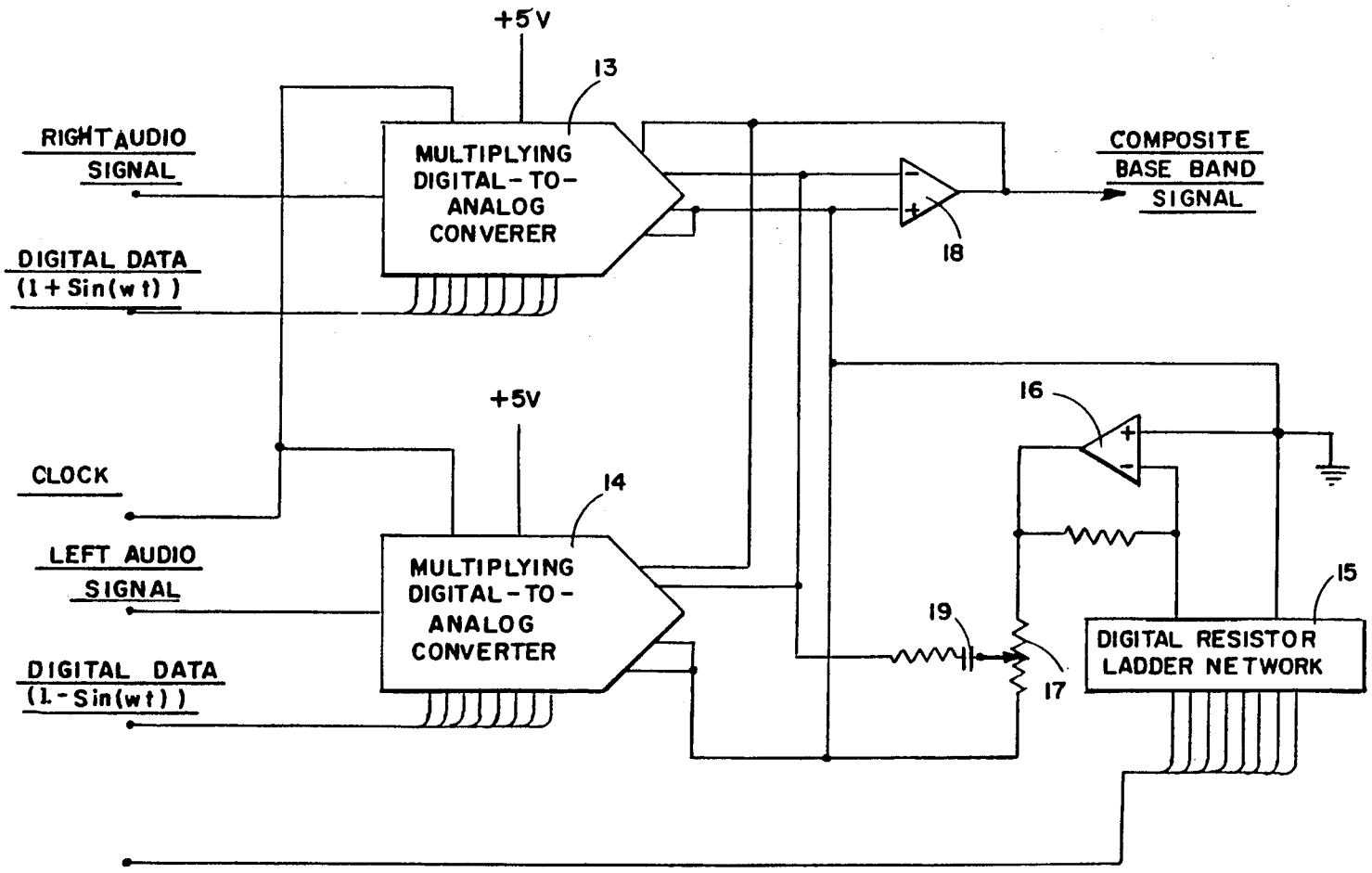
FIG. 6 is a diagram of the multiplying modulator portion of the invention.

Referring now to FIG. 6, multiplying digital-to-analog converters 13 and 14, such as an AD7524, respectively receive the digital representations of the functions $(1+\sin(wt))$ and $(1-\sin(wt))$ and respectively the analog representation of the right audio signal, R, and the left audio signal, L, and each provides as an output a current that is the analog representation of the product of these functions and signals, i.e. converter 13 outputs a current that is proportional to $R(1+\sin(wt))$ and converter 14 outputs a current that is proportional to $L(1-\sin(wt))$. Thus multiplying digital-to-analog converters 13 and 14 function as multipliers 2 and 3 depicted in FIG. 4.

The digital representation of the pilot subcarrier that is output from strobed data latch 12 is converted to an analog representation of the pilot subcarrier by digital resistor ladder network 15, such as a R-2R resistor ladder made by Allen Bradley, together with operational amplifier 16. The amplitude of the pilot subcarrier is controlled by potentiometer 17 and capacitor 19 is interposed between potentionmeter 17 and operational amplifier 18 so as to remove the d.c. component of the signal output from operational amplifier 16.

The currents output from multiplying digital-to-analog converters 13 and 14 and the pilot subcarrier output from potentiometer 17 are added together in operational amplifier 18. An operational amplifier such as an OP260 is suitable for use as operational amplifiers 16 and 18. Because the currents from converters 13 and 14 and from potentiometer 17 are added together at one input into operational amplifier 18, the operational amplifier, in effect, acts as the summer 5 depicted in FIG. 4 to combine these signals into one signal which is the composite baseband signal. Pin 7 of operational amplifier 18 is connected to pins 16 of multiplying digital-to-analog converters 13 and 14 in order to reduce the effect of temperature fluctuations upon the magnitude of the multiplication provided by converters 13 and 14.

Although digital devices are utilized in the embodiment described above to generate the functions $(1+\sin(wt))$ and $(1-\sin(wt))$ and to multiply the right and left audio signals respectively with these functions, it should be understood that analog devices, or a combination of analog and digital devices may be used to mechanize these elements of the invention. It should be further understood that although the invention has been described with respect to audio input signals and a subcarrier frequency of 38 kilohertz, the same invention could be used with input signals at other than audio frequencies and with a subcarrier at some frequency other than 38 kilohertz. It should further be understood that the outputs from multipliers 2 and 3 may include a multiplicative constant factor.

I claim:

1. A discrete, parallel path modulation multiplexer of the type having as inputs a left signal and a right signal and having as an output a composite signal, the composite signal including a main channel signal that is substantially equivalent to the sum of the left signal and the right signal, and the composite signal further including a subchannel signal that is substantially equivalent to the output of a double sideband, suppressed carrier modulator having as an input a subcarrier, denoted as sin(wt), and being modulated by the difference between the right signal and the left signal comprising, function generating means for generating the function (1+sin(wt)) and the function (1−sin(wt)), left multiplying means for generating a multiplied left signal substantially equivalent to the product of the left signal and the function (1+sin(wt)), right multiplying means for generating a multiplied right signal substantially equivalent to the product of the right signal and the function (1 —sin(wt)), summation means for summing together the multiplied left signal and the multiplied right signal, the summation of the multiplied left signal and the multiplied right signal comprising the composite signal output by the discrete, parallel path modulation multiplexer.

2. The device described in claim 1 wherein the function generating means comprises means for generating a digital representation of the function (1 +sin(wt)) and the function (1−sin(wt)), and wherein the left multiplying means comprises a left multiplying digital to analog converter having the left signal and the digital representation of the function (1+sin(wt)) as its inputs and producing as its output the product of the left signal and the function (1+sin(wt)), and wherein the right multiplying means comprises a right multiplying digital to analog converter having the right signal and the digital representation of the function (1−sin(wt)) as its inputs and producing as its output the product of the right signal and the function (1−sin(wt)), 3. The device described in claim 1 wherein said function generating means further comprises means for generating a pilot subcarrier and for including the pilot subcarrier as part of the composite signal output by the discrete, parallel path modulation multiplexer.

4. The device described in claim 2 wherein said function generating means further comprises means for generating a pilot subcarrier and for including the pilot subcarrier as part of the composite signal output by the discrete, parallel path modulation multiplexer.

* * * * *